United States Patent [19]

Mueller

[11] 4,236,379

[45] Dec. 2, 1980

[54] HEAT PUMP COMPRESSOR CRANKCASE LOW DIFFERENTIAL TEMPERATURE DETECTION AND CONTROL SYSTEM

[75] Inventor: Dale A. Mueller, St. Paul, Minn.

[73] Assignee: Honeywell Inc., Minneapolis, Minn.

[21] Appl. No.: 868

[22] Filed: Jan. 4, 1979

[51] Int. Cl.[3] ..... F04B 49/10; F25B 49/00

[52] U.S. Cl. ..... 62/126; 62/193; 62/472; 417/32

[58] Field of Search ..... 62/193, 211, 127, 126, 62/472, 228 R, 229; 417/32

[56] References Cited

U.S. PATENT DOCUMENTS

| | | | |
|---|---|---|---|
| 4,004,431 | 1/1977 | Hildreth | 62/472 |
| 4,136,822 | 1/1979 | Felter | 236/49 |

*Primary Examiner*—William E. Wayner

*Attorney, Agent, or Firm*—Roger W. Jensen

[57] ABSTRACT

A compressor crankcase low differential temperature detection and control system for a reverse-cycle refrigeration system for detecting an abnormally low temperature crankcase and for controlling the system in response to such fault detection by inhibiting the operation of the compressor and for providing a fault indication.

8 Claims, 2 Drawing Figures

HEAT PUMP COMPRESSOR CRANKCASE LOW DIFFERENTIAL TEMPERATURE DETECTION AND CONTROL SYSTEM

BACKGROUND OF THE INVENTION

Heat pumps have been used for many years in the heating and cooling of buildings; their popularity has substantially increased in recent times because of the soaring costs of energy used for heating and cooling. Heat pumps become more and more attractive for the function of heating and cooling of buildings because of their operating efficiency; i.e., their cost effectiveness. However, heat pumps do have some problems; one of these is connected with the fact that in many systems the refrigerant in the line may, during times that the system is at rest, settle in the crankcase of the compressor. This is because, in the system "OFF" condition, the refrigerant in the reverse cycle heat pump will tend to condense at the location which has the lowest temperature in the system. The "coldest" location typically is in the outdoor unit (where the compressor is usually located) when a system is in the heating mode, because the outdoors is generally much cooler than the indoors for this case. Thus, the refrigerant may settle, i.e., condense in the crankcase of the compressor; the refrigerant will continue condensing at such coldest location until a point of equilibrium is reached, i.e., an equilibrium of liquid and gaseous refrigerant at the vapor pressure corresponding to the temperature at such coldest location. It has been recognized heretofore that it is important not to start up the compressor when the refrigerant has settled in the compressor crankcase as it is known that the refrigerant in the crankcase will tend to mix with the compressor lubricating oil therein. It is likely that this mixture is present at equilibrium because the mixture causes a reduction in the total volume of liquid as compared with a system containing separate pools of oil and refrigerant, thus enabling more refrigerant to condense at the same equilibrium vapor pressure. Thereafter, when the compressor is started, if there is refrigerant in the crankcase oil, then such refrigerant will tend to boil due to the low pressure on the suction side of the compressor (where the crankcase is located) and when this happens the refrigerant will agitate the oil causing the oil to foam; this foam then is apt to be carried into the intake of the compressor and thereafter be pumped out by the compressor into the refrigerant lines. When this happens, the oil may be pumped out of the crankcase, thus causing the compressor to run without lubricant until the oil migrates back having travelled throughout the complete refrigeration system; i.e., back through the refrigerant tubes and into the crankcase. Such running without lubrication may cause severe wear and overheating of the compressor, thus shortening the life of the compressor and causing expense, inconvenience and discomfort. Another related problem is that the oil refrigerant foam mixture is not as compressible as refrigerant vapor; this can cause "slugging" and eventual damage to the valves of the compressor.

All of the foregoing has heretofore been recognized and various prior art techniques have been proposed for dealing with the problem. Thus, at this time, many heat pump compressors have some means for heating the crankcase of the compressor so that the crankcase will not be the lowest temperature point in the heat pump system; thus preventing the refrigerant from condensing in the crankcase and thus preventing the above-described damages to the compressor. Thus, a frequent practice has been, in connection with the installation of a new heat pump system, to refrain from starting up the compressor for a period of time allowing the crankcase heating means to vaporize any accumulated refrigerant in the crankcase. However, frequently in practice (either through carelessness or ignorance) the heat pump installer will energize or turn on the compressor immediately; i.e., without waiting for the warming up interval, and hence cause damage to the compressor. Also, a crankcase heater failure will cause every compressor start with potential to dying. Also, an extended heater power loss could cause foaming.

It is an object of our invention to provide a new and effective system for detecting compressor crankcase low differential temperatures and for inhibiting the operation of the heat pump compressor until such time as the crankcase temperature increases above the outdoor air temperature to a safe level.

SUMMARY OF THE INVENTION

The present invention is a compressor crankcase low differential temperature detection and control system for a reverse cycle refrigeration system comprising the usual refrigerant compression means, including crankcase heating means, indoor and outdoor coils, refrigerant conduit means connecting the compression means and the coils, and refrigerant compression control means. In particular, the control system comprises outdoor air temperature sensing means having an output indicative of outdoor air temperature, crankcase temperature sensing means having an output indicative of the crankcase temperature, enclosure (e.g., building) temperature sensing means having an output indicative of a demand for either heating or cooling of the enclosure, fault indicator means, and controller means. The controller means has operative connections to the three recited temperature sensing means so as to receive the outputs thereof. The controller means further has a circuit connect-disconnect means which selectively interconnects the enclosure temperature sensing means to the refrigerant compression control means. The controller functions so that it is effective to inhibit the compression means from operating if both the outdoor air temperature is below a predetermined value and if the value of the crankcase temperature minus the outdoor air temperature is greater than a preselected amount.

DESCRIPTION OF THE PREFERRED EMBODIMENT

Figure 1:
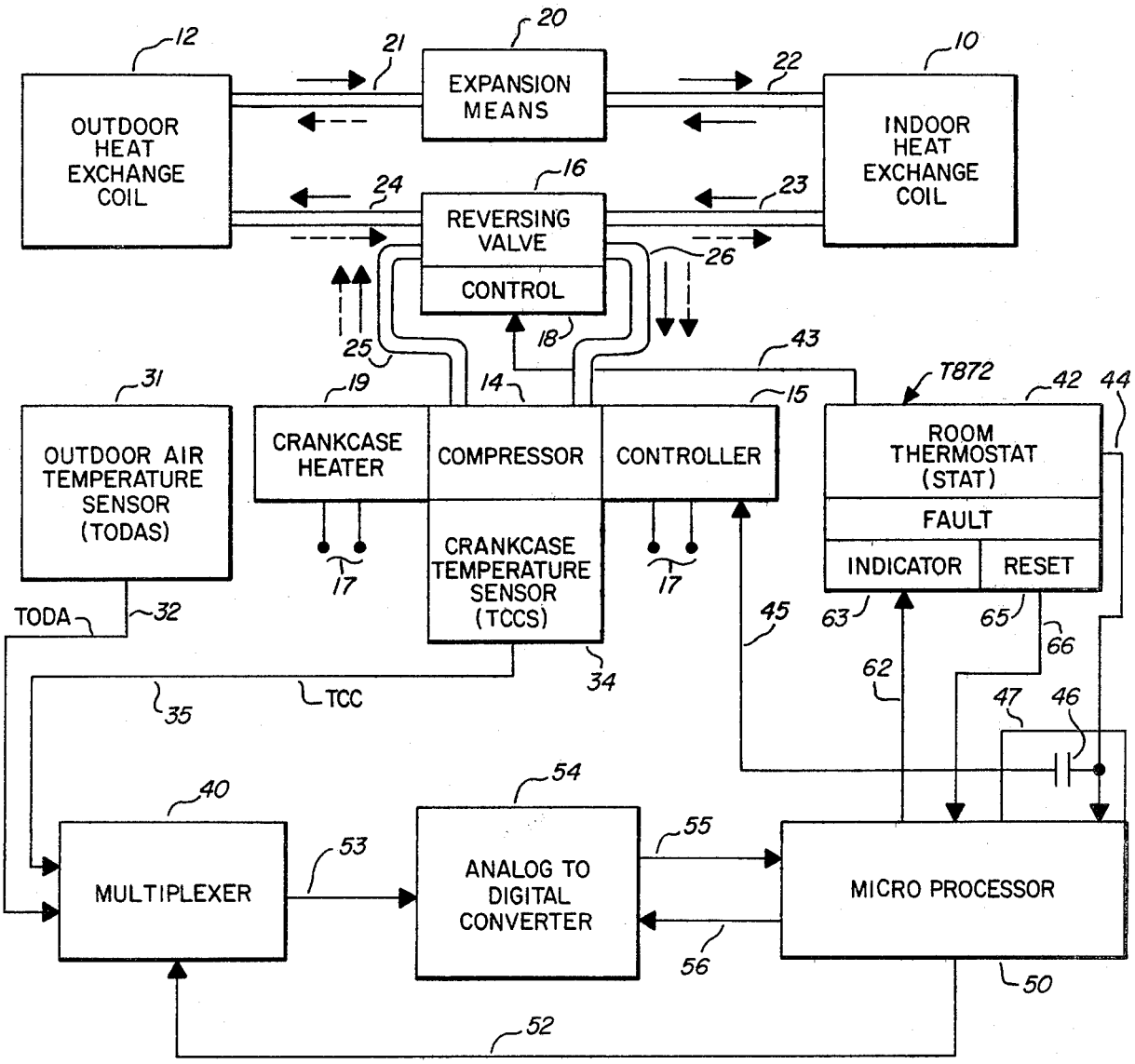
FIG. 1 is a block diagram of a compressor crankcase low temperature detection and control system for a reverse cycle refrigeration system embodying the present invention.

Referring to FIG. 1, the reverse cycle refrigeration system comprises an indoor heat exchange coil 10, an outdoor heat exchange coil 12, a refrigerant compression means or compressor 14, and a compressor controller 15 receiving energization from an appropriate source 17 of electrical energy. Also associated with the compressor 14 is a crankcase heater 19 receiving energization from source 17. Refrigerant conduit means are provided for interconnecting the coils and the compressor, the conduit means including the usual reversing valve 16 having a controller 18, an expansion means 20 and appropriate interconnecting piping 21–26. The system above-described is representative of prior art systems such as that shown in U.S. Pat No. 3,170,304. As is well known, such systems function whenever the building thermostat is calling for heating or cooling to cause compressor 14 to operate. If heating is being demanded then the compressed hot refrigerant from the compressor 14 will be routed through the reversing valve 16 toward the indoor heat exchange coil 10 where its heat is given up to heat the indoor air. Conversely, if cooling of the building is being demanded, then the hot refrigerant from the compressor is routed through the reversing valve to the outdoor heat exchange coil 12 where the refrigerant is cooled for subsequent use indoors to cool the building.

The compressor crankcase low temperature detection and control system as depicted in FIG. 1 comprises an outdoor air temperature sensing means 31 (hereinafter sometimes referred to as "TODAS") having an output 32 on which is an output signal indicative of the outdoor air temperature (hereinafter sometimes referred to as "TODA"). TODA on output 32 comprises one of two separate inputs to a multiplexer 40 to be described in more detail below. The detection and control system further comprises a crankcase temperature sensing means 34 (hereinafter sometimes referred to as "TCCS") having an output 35 on which is available an output signal indicative of the crankcase temperature of the compressor, this temperature hereinafter sometimes being referred to as "TCC", such TCC signal on 35 comprising the second input to multiplexer 40. The detection and control system further includes a room thermostat 42 (hereinafter sometimes referred to as "STAT") which responds to the temperature of a room or space in a building or the like, the temperature of which is to be controlled by the reverse cycle refrigeration system. Room thermostat 42 is depicted as having a first output 43 connected to the control 18 for the reversing valve 16. A second output 44 of STAT 42 is connected to a microprocessor 50 and also (through a set of contacts 46 and a connection means 45) to the controller 15 of compressor 14. Contacts 46 are contained within a subsection 47 of the microprocessor 50 and both 47 and 50 will be described in more detail below.

A Honeywell Inc. Model T872 heating-cooling thermostat may be used for the room thermostat 42 depicted in FIG. 1, the Model T872 being of the bimetal operated mercury switch type including switch means for providing the heating-cooling control signals and also for controlling a plurality of auxiliary heating means. As will be understood, whenever STAT 42 calls for either heating or cooling of the controlled space, then a control signal is effectively supplied on outputs 43 and 44 thereof, the control signal at 43 functioning to position via control 18 the reversing valve 16 to the proper orientation for either heating or cooling of the building and at 44 to advise microprocessor 50 that heating or cooling has been called for by STAT 42. The control signal at 44 is transmitted through the normally closed contacts 46 and connection 45 to control the compressor 14 from a rest or "off" condition to an operating or "on" condition and is also applied to microprocessor 50 to indicate a demand for compressor 14 operation. The Honeywell Model T872 STAT further includes a fault indicator 63 and a fault reset means 65, i.e., a switch, both of which will be described in further detail below. For convenience, elements 42, 63 and 65 as above described are shown adjacent to one another in FIG. 1, all having the common designator T872.

Further, Honeywell Inc. platinum film resistance type temperature sensors models C800A and C800D may be used for TODAS 31 and TCCS 34 respectively. Also, a Carrier Corporation heat pump comprising outdoor unit model No. 38CQ033300 and indoor unit model No. 40AQ036300JR may be used for the basic heat pump unit depicted in FIG. 1; i.e., components 10, 12, 14, 15, 16 and 19.

As indicated above, multiplexer 40 has applied thereto at 32 and 35 analog signals representative of TODA and TCC respectively. The function of the multiplexer 40 is to supply one or the other of the two input signals in analog form to the output 53 thereof, depending upon the nature of the control signal being applied to the multiplexer 40 via a lead 52 from the microprocessor 50; i.e., the microprocessor provides a control for the multiplexer 40 to select which of the two input signals is applied to output 53. Output 53 is applied as the input to a standard analog-to-digital converter 54 (herein sometimes referred to as "A/D") having an output 55 connected as a second input to the microprocessor 50 and also having an input 56 for receiving controlling instructions from the microprocessor 50. The output from analog-to-digital converter 54 at output 55 is a signal in digital form indicative of the analog signal applied to input 53. The microprocessor 50 has an output 62 connected to fault indicator 63. The apparatus further includes the above-mentioned fault reset means 65 having an output 66 which constitutes a third input to the microprocessor 50.

A suitable microprocessor that may be used in the present invention as a component of the system depicted in FIG. 1 is the Intel Corporation Model 8049; a suitable representative analog-to-digital converter for use to provide the function of block 54 in FIG. 1 is the Texas Instrument Inc. Model TL505C (see TI Bulletin DLS 12580); and an appropriate multiplexer is the Motorola Inc. Model MC14051BP.

It will be understood by those skilled in the art that the functional interconnections depicted in FIG. 1 are representative of one or more electrical wires or pipes, as the case may be, as dictated by the specific equipment used.

Figure 2:
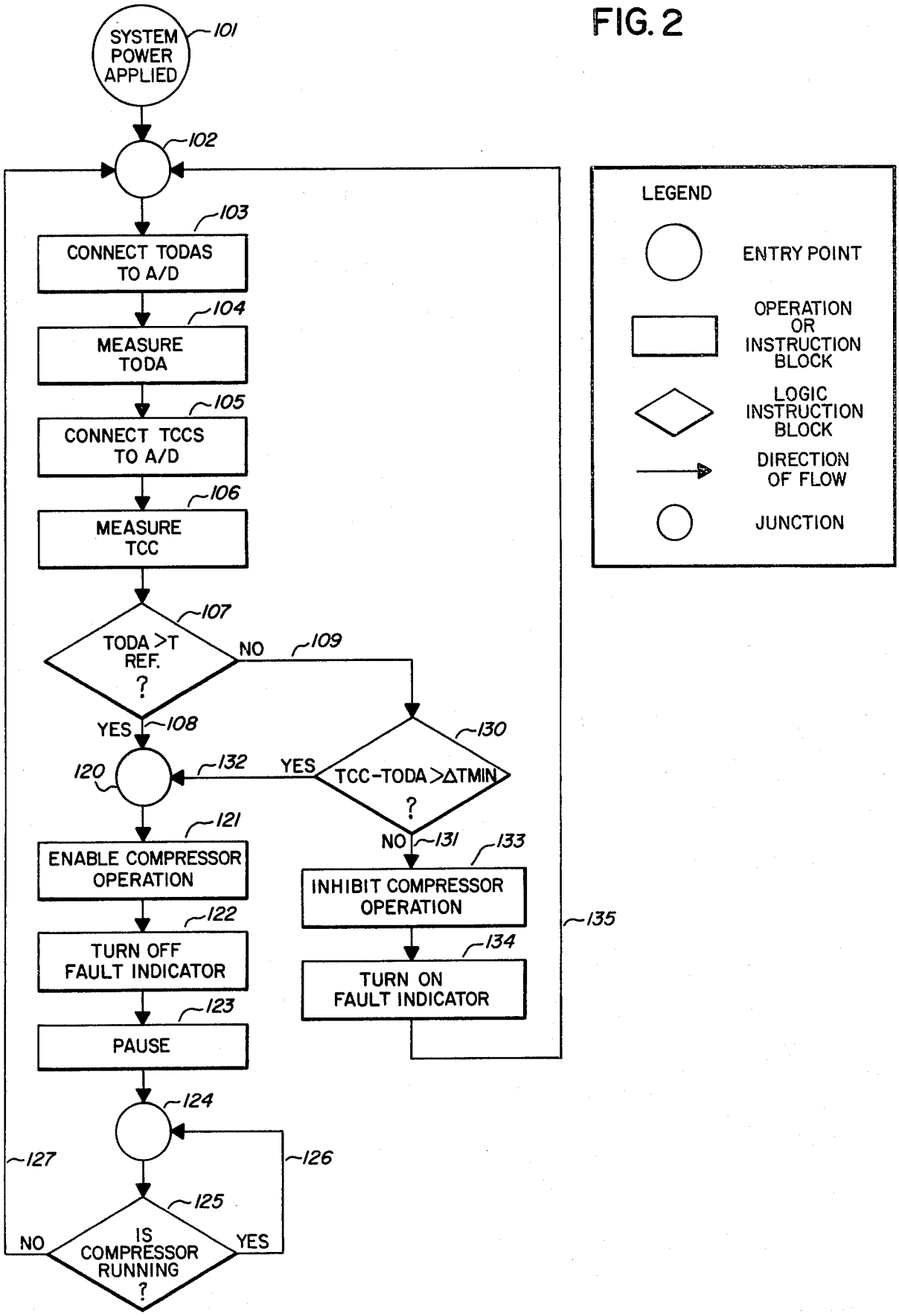
FIG. 2 is a flow chart for the control of the apparatus depicted in FIG. 1.

The detailed operation of the detection and control system of FIG. 1 may be more specifically understood by reference to the flowchart depicted in FIG. 2 where reference numeral 101 designates an entry point "system power applied" reflecting the status of the heat pump being powered up; i.e., power 17 being applied to compressor controller 15 and crankcase heater 19 and appropriate energization being applied to any other of the depicted apparatus requiring same. The system then flows via junction 102 to instruction block 103 "connect TODAS to A/D"; this being indicative of the TODA signal on output 32 being applied via multiplexer 40 to the analog-to-digital (A/D) converter 54. The flow from 103 is to operation or instruction block 104 "measure TODA" the flow from which is to instruction block 105 "connect TCCS to A/D", the flow from which is to instruction block 106 "measure TCC". Thus, instructions 103, 104, 105, and 106 collectively are associated with the measurement of the TODA and TCC temperatures, utilizing the aforedescribed multiplexer 40, analog-to-digital converter 54 and microprocessor 50.

The flow from block 106 is to a logic instruction 107 "TODA > $T_{REF.}$?" having a yes response 108 and a no response 109. $T_{REF.}$ is a reference temperature or set point with respect to which TODA is compared; and is selected to be a temperature high enough so that refrigerant would not normally condense in the crankcase or in the outdoor coil; i.e., the refrigerant would stay in gaseous form in the crankcase and in the outdoor coil, and instead the refrigerant would condense in the cooler indoor coil. A representative $T_{REF.}$ would be 80° F. If TODA is greater than $T_{REF.}$ then there is not likely to be a problem with refrigerant mixing with the oil of the compressor crankcase; hence, the yes response 108 flows via a junction 120 to an instruction block 121 "enable compressor operation", the flow from which is to instruction block 122 "turn off fault indicator", the flow from which is to instruction block 123 "pause", the flow from which is via a junction 124 to a logic instruction block 125 "is compressor running?" having a yes response 126 and a no response 127. Thus, a yes response at 108 from logic block 107 is representative of an absence of any possible problem and hence is compatible with normal operation vis: block 121 designates the enabling of compressor operation and 122 is representative of the fault indicator 63 being turned off. The block 123 "pause" is indicative of the periodic recylcling of the system, i.e., the periodic functioning of the system to determine whether or not there is a problem with the temperature of the crankcase of the compressor, a frequency of 120 cycles per hour having been found satisfactory. Flow from 123 via 124 into logic block 125 "is compressor running?" results in either a yes or a no response; a yes response 126 flows back to junction 124 and thence to 125 in a closed loop fashion; however, a no response 127 (indicating that the compressor is not running) causes flow back to junction 102 so that the test at logic instruction block 107 may be repeated.

When TODA is not greater than $T_{REF.}$, then the no response 109 from logic instruction 107 causes flow to a logic instruction block 130 "TCC minus TODA is greater than $\Delta T_{MIN}$?" having a no response 131 and a yes response 132. Logic instruction block 130 thus provides a comparison between (i) $\Delta T$, i.e., the difference in magnitude between the compressor crankcase temperature TCC and the outdoor air temperature TODA and (ii) $\Delta T_{MIN}$ where $\Delta T_{MIN}$ is a predetermined value. If $\Delta T$ is greater than $\Delta T_{MIN}$, then this is indicative of a safe operating condition, i.e., the crankcase temperature being sufficiently greater than the outdoor air temperature so as to confirm that the crankcase heating means has been operated a sufficient length of time so as to boil away any refrigerant that otherwise might be comingled with the oil in the crankcase. Such "safe operating" condition causes a yes response 132 to flow via junction 120 to 121 et seq. A value of $\Delta T_{MIN}$ of 10° F. has been found satisfactory for TODA less than 55° F. and 6° F. for TODA greater than 55° F. However, if the crankcase temperature is not high enough, then the no response 131 from 130 will cause flow to an instruction bloc 133 "inhibit compressor operation", the flow from which is back to junction 10 described above via a connection 135. Thus, if the crankcase temperature is too low in comparison to the outdoor air temperature, this is indicative of a potential severe problem as described aforesaid; thus, the no response at 131 causes two events/operations. The first is the inhibiting of the compressor operation; block 133 is indicative of microprocessor 50 operating to open contacts 46 to prevent STAT 42 commanding operation of compressor 14. The second operation resulting from a no response 131 is the actuation of fault indicator 63 (by block 134). The closing of the loop by 135 back to 132 permits the test to be repeated; as long as the response from logic instruction 130 continues to be a "no" response at 131, then the compressor operation will be inhibited and the fault indicator 63 will be actuated. Knowledgeable personnel noting that the fault indicator 63 is actuated may take corrective steps, one of which is to permit the passage of enough time to permit the crankcase heater to function. In due course the crankcase temperature should increase to the point where the output from 130 will be a yes response 132 to flow through 120 to block 121 et seq so as to successively enable compressor operation and to turn off the fault indicator 63. On the other hand, a persistent fault indication at fault indicator 63 would necessitate further investigation by appropriate servicing personnel to determine and correct the cause of the fault.

As indicated above, an Intel Model 8049 microprocessor may be used to practice the subject invention; as an assistance reference may be made to "INTEL$^R$ MCS-48$^{TM}$ Family of Single Chip Microcomputers—User's Manual", a 1978 copyrighted manual of the Intel Corporation, Santa Clara, California 95051. As a further assistance, Appendix A hereto and forming a part hereof, comprises a table of machine readable instruction for controlling the aforesaid Intel Model 8049 microprocessor for use in the present invention.

While we have described a preferred embodiment of our invention, it will be understood that the invention is limited only by the scope of the following claims:

I claim:

1. A compressor crankcase low differential temperature detection and control system (hereinafter "control system") for a reverse cycle refrigeration system (hereinafter "system") for heating and cooling an enclosure wherein said system comprises refrigerant compression means including crankcase heating means, refrigerant compression control means, an indoor coil, an outdoor coil, and refrigerant conduit means connecting said compression means and said coils, said control system comprising:

outdoor air temperature sensing means (hereinafter "TODAS") having an output indicative of outdoor air temperature (hereinafter "TODA");

compressor crankcase temperature sensing means (hereinafter "TCCS") having an output indicative of the temperature (hereinafter "TCC") of the crankcase of said refrigerant compression means;

enclosure temperature sensing means (hereinafter "STAT") having an output indicative of a demand for heating or cooling of the enclosure; and controller means having operative connections to said TODAS, TCCS, and STAT so as to receive the outputs thereof, said controller means including circuit connect-disconnect means selectively interconnecting said STAT output to said refrigerant compression control means whereby, when said STAT output is connected thereto, said compression means is enabled to operate in response to a demand from said STAT for heating or cooling and, when said STAT output is disconnected therefrom, said compression means is inhibited from operating, said controller means being effective to inhibit said compression means from operating whenever the value of TCC minus TODA is less than a preselected amount, and said controller means being further characterized by permitting operation of said compression means whenever TODA is greater than a predetermined value.

2. Apparatus of claim 1 further characterized by said preselected amount being 10° Fahrenheit when TODA is less than 55° F. and 6° F. when TODA is greater than 55° F.

3. Apparatus of claim 1 further characterized by (i) said control system including fault indicator means and (ii) said fault indicator means being actuated upon, as aforesaid, said controller means inhibiting said compression means from operating.

4. Apparatus as described in claim 3 further characterized by said controller means permitting operation of said compression means whenever TODA is greater than a predetermined value.

5. Apparatus of claim 1 further characterized by said preselected amount being in the range of 6 to 15 degress Fahrenheit.

6. Apparatus of claim 4 further characterized by said preselected amount being in the range of 6 to 15 degrees Fahrenheit.

7. Apparatus of claim 6 further characterized by said predetermined value being in the range of 80° F.±10° F.

8. Compressor crankcase low differential temperature detection and control system (hereinafter "control system") for a reverse cycle refrigeration system (hereinafter "system") for heating and cooling an enclosure wherein said system comprises refrigerant compression means including crankcase heating means, refrigerant compression control means, an indoor coil, an outdoor coil, and refrigerant conduit means connecting said compression means and said coils, said control system comprising:

outdoor air temperature sensing means (hereinafter "TODAS") having an output indicative of outdoor air temperature (hereinafter "TODA");

compressor crankcase temperature sensing means (hereinafter "TCCS") having an output indicative of the temperature (hereinafter "TCC") of the crankcase of said refrigerant compression means;

enclosure temperature sensing means (hereinafter "STAT") having an output indicative of a demand for heating or cooling of the enclosure; and controller means having operative connections to said TODAS, TCCS, and STAT so as to receive the outputs thereof, said controller means including circuit connect-disconnect means selectively interconnecting said STAT output to said refrigerant compression control means whereby, when said STAT output is connected thereto, said compression means is enabled to operate and, when said STAT output is disconnected therefrom, said compression means is inhibited from operating, said controller means being effective to inhibit said compression means from operating unless one of the following conditions is satisfied:

(1) TODA is above a predetermined value; or (2) the value of TCC minus TODA is greater than a preselected amount.

* * * * *